US006524162B1

(12) United States Patent
Hauser

(10) Patent No.: US 6,524,162 B1
(45) **Date of Patent: *Feb. 25, 2003**

(54) SLICING CENTER

(75) Inventor: Charles Hauser, Genolier (CH)

(73) Assignee: HCT Shaping Systems SA, Cheseaux (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 842 days.

(21) Appl. No.: 08/873,250

(22) Filed: Jun. 11, 1997

(30) Foreign Application Priority Data

Jun. 19, 1996 (CH) ..... 1532/96

(51) Int. Cl.[7] ..... B24B 1/00
(52) U.S. Cl. ..... 451/5; 451/69; 125/16.01
(58) Field of Search ..... 451/5, 69; 125/16.01; 364/468.28, 468.02, 131, 132

(56) References Cited

U.S. PATENT DOCUMENTS

| | | | | |
|---|---|---|---|---|
| 3,736,968 A | | 6/1973 | Mason | |
| 4,719,694 A | | 1/1988 | Herberich et al. | |
| 5,164,905 A | | 11/1992 | Iwasaki et al. | |
| 5,246,524 A | | 9/1993 | Kuroda et al. | |
| 5,255,197 A | | 10/1993 | Iida | |
| 5,269,285 A | * | 12/1993 | Toyama et al. | 125/16.01 |
| 5,305,652 A | * | 4/1994 | Zimmer | 74/479 |
| 5,396,433 A | * | 3/1995 | Kosugi | 364/468.28 |
| 5,399,531 A | * | 3/1995 | Wu | 364/468.28 |
| 5,536,128 A | * | 7/1996 | Shimoyashiro et al. | 364/468.28 |
| 5,537,325 A | * | 7/1996 | Iwakiri et al. | 364/468.28 |
| 5,653,622 A | * | 8/1997 | Drill et al. | 451/5 |
| 5,667,423 A | * | 9/1997 | Itoi | 451/5 |

FOREIGN PATENT DOCUMENTS

| | | | |
|---|---|---|---|
| JP | 28543 | * 2/1988 | 364/468 |
| JP | 4-282702 | 10/1992 | |
| JP | 7-006939 | 1/1995 | |
| JP | 8-110805 | 4/1996 | |

* cited by examiner

*Primary Examiner*—George Nguyen
(74) *Attorney, Agent, or Firm*—Young & Thompson

(57) ABSTRACT

A slicing center includes a first structure (23) to carry out operations (24) necessary for the production of processed slices in trays or packaged, from pieces to be sliced. These operations (24) are controlled and interconnected by a second structure (25) so as to form subgroups (26) consisting of a positioning unit, a slicing unit, a processing unit and a final treatment unit. These subgroups (26) are in turn interconnected by third structure (27) comprising devices for storing and devices for handling and transportation of the slices, thereby to form a chain of transfer in which all the elements are compatible and interconnected.

15 Claims, 4 Drawing Sheets

SLICING CENTER

The present invention relates to a slicing center adapted to produce slices from pieces to be sliced.

The production of slices from ingots is usually carried out with a series of successive steps grouping in an erratic manner a certain number of machines or devices that are more or less various, generally made to carry out a precise function, but with no considered relationship with the preceding or subsequent operations. The integration is generally carried out by the user with more or less difficulty or success and with more or less automation.

During cutting thin slices from material in the form of ingots, a certain number of operations must be carried out and the slices obtained must be processed so as to permit treating them without restriction according to the needs of the user. The difficulty of integrating the operations depends on the methods used for cutting the slices.

Beginning with the piece to be sliced, generally in the form of an ingot, the following operations must be carried out. The ingots are fixed on a support in a position which must be quite precise, if they are a monocrystal in which the orientation of the crystalline structure plays a role. In this case, a determination of the orientation must be made by x-rays for example and positioning is necessary. Once the piece to be sliced is positioned and fixed on its support, the latter is mounted on the slicing device which can be a diamond blade saw or a wire saw or any other means permitting slicing the material either simultaneously or piece by piece. There then follows an operation of rough cleaning and a processing of the obtained slices. This processing generally is carried out in packaging which maintains each slice separate from the following to avoid any contact between them which could give rise to chipping. This type of packaging is called a tray and is used for transporting the slices for subsequent operations. Each of the above operations requires first means to be carried out. All the operations comprised between the ingot and the processed slices take place now in an independent manner with the first means and with a large manual component, with corresponding labor, and hence a high cost.

The object of the present invention consists in overcoming these drawbacks, and it is characterized to this end by the fact that the slicing center comprises, united in a same assembly, first means to carry out the necessary operations for the production of the processed slices for ultimate use from pieces to be sliced and by the fact that these operations are controlled and interconnected by second means so as to form subgroups and by the fact that these subgroups are themselves connected together by third means thereby forming a transfer chain in which all the operations and all the means are compatible and interconnected to comprise the slicing center.

Thanks to these characteristics, the slices can be produced in an automated manner with very high output, with increased reliability and safety, with uniform and excellent quantity and at a lower cost.

The integration into subgroups by the second means and then the complete integration, by third means, of the individual operations of protection constituted by the first means, can be carried out so as to render the assembly semiautomatic, hence to replace a series of well separated steps, difficult to coordinate for the user, by a single operation which consists in putting back the pieces to be sliced or the ingots and to receive in return the processed slices in a preselected packaging. It is therefore a matter of supplying to the user an automatic or semiautomatic slicing center according to an overall concept for the production of slices.

The practice of the overall concept remedies the drawbacks of multiple steps necessary at present for the production of slices from the ingot to the processed slice by supplying an overall concept integrating all of the necessary operations and hence the first means. The user no longer need make each operation compatible with the following one, because this is done by the second and/or third means.

To carry out the global concept principle, a certain number of operations should be grouped, hence by the first means, in subgroups each of which comprises, by means of the second means, a portion of the chain, then to connect them to each other by third means so as to give to the assembly the character of a transfer chain and thereby to satisfy the principle of a global concept of a slicing center.

The subgroups can be in series in the following manner:

1) unit for securement of the piece to be sliced or of the ingot and orientation in position if necessary,
2) slicing unit constituted by one or several slicing devices,
3) processing unit constituted by one or several processing devices,
4) subsequent operations as chosen by the user.

The securement of the ingot or of the piece to be sliced, as well as its spatial orientation with possible inspection of the crystal by X-ray or by optical methods, can be carried out by second means in the form of a computer controlled robot and coordinating the operations of orientation and of securement in position, as well as the measuring of the ingots. The first means being in this case constituted among other things by the securement stations, the R-X measurement station, if desired a cleaning station, this list not being exhaustive.

The emplacement in the slicing unit of the pieces to be sliced can also be carried out by second means in the form of a manipulating robot again controlled by computer and always keeping the outline of the piece to be sliced. Once sliced, the piece to be sliced can be taken back by the same manipulator robot to be transferred to the processing unit. This operation is in general necessary only when the slicing in a group, by a wire saw or multiple blades, for example. In the case of piece-by-piece slicing, the slices will be taken back directly after each other from the slicing unit to be processed in the processing unit. The first means of the slicing unit can be constituted by an assembly of one or several abrasive slicing devices, free or fixed, such as wire saws, diamond blade saws or multiblades.

The processing unit will receive the slices either in the form of pieces sawed in slices, but always attached together generally by a cemented heel, or else in the form of separate slices but having also an adhesive heel. The processing unit should then distribute the slices in containers called trays and maintain these latter separated from each other. The processing unit can also have a role in cleaning the slices or removing the heel, but may also insert other operations such as chamfering or marking or again inspection operations and rejection operations each of which comprises one of the first means, the second means being adapted to be constituted by conveyor belts interconnecting the various first means.

Once out of the processing unit, the reattachment and other operations are no longer a matter of choice for the user because these operations are in general well known and rely practically all on slices processed and held in trays.

To connect the different subgroups and to make a unit of them, it is possible, but not always absolutely necessary, to create intermediate storages which constitute in part the third means. Thus the following intermediate storages can be envisioned:

1) input storage which receives the ingots ready to be sliced,
2) first intermediate storage after mounting and if desired orientation and before slicing,
3) second intermediate storage after the slicing unit and before the processing unit,
4) storage of the output after the processing unit and before the subsequent operations defined by the user.

The passage between the different subgroups constituting the first and second means through intermediate storages can be carried out by a robot independent and separate from the second means. This independent robot thus constitutes with the intermediate storages, the third means. However, and in most cases, the second means are sufficient to ensure the transfer and operations and functions of the third means and hence can be carried out entirely or only partially by the second means or integrated with the latter.

Thus, the invention permits the slicing unit according to the global slicing concept, to become a slicing center and thereby to avoid the multiple steps which require great labor and difficulties of keeping the shape of each piece to be sliced. The slicing center is hence constituted by first means to carry out the necessary operations, second means permitting controlling a series of operations among themselves and thus constituting a subgroup of operations, and third means interconnecting the subgroups to produce a single transfer chain called a slicing center.

Other advantages will become apparent from the characteristics expressed in the dependent claims and of the description set forth hereafter of the invention more in detail with the aid of drawings which represent schematically and by way of example various embodiments.

Figure 1:
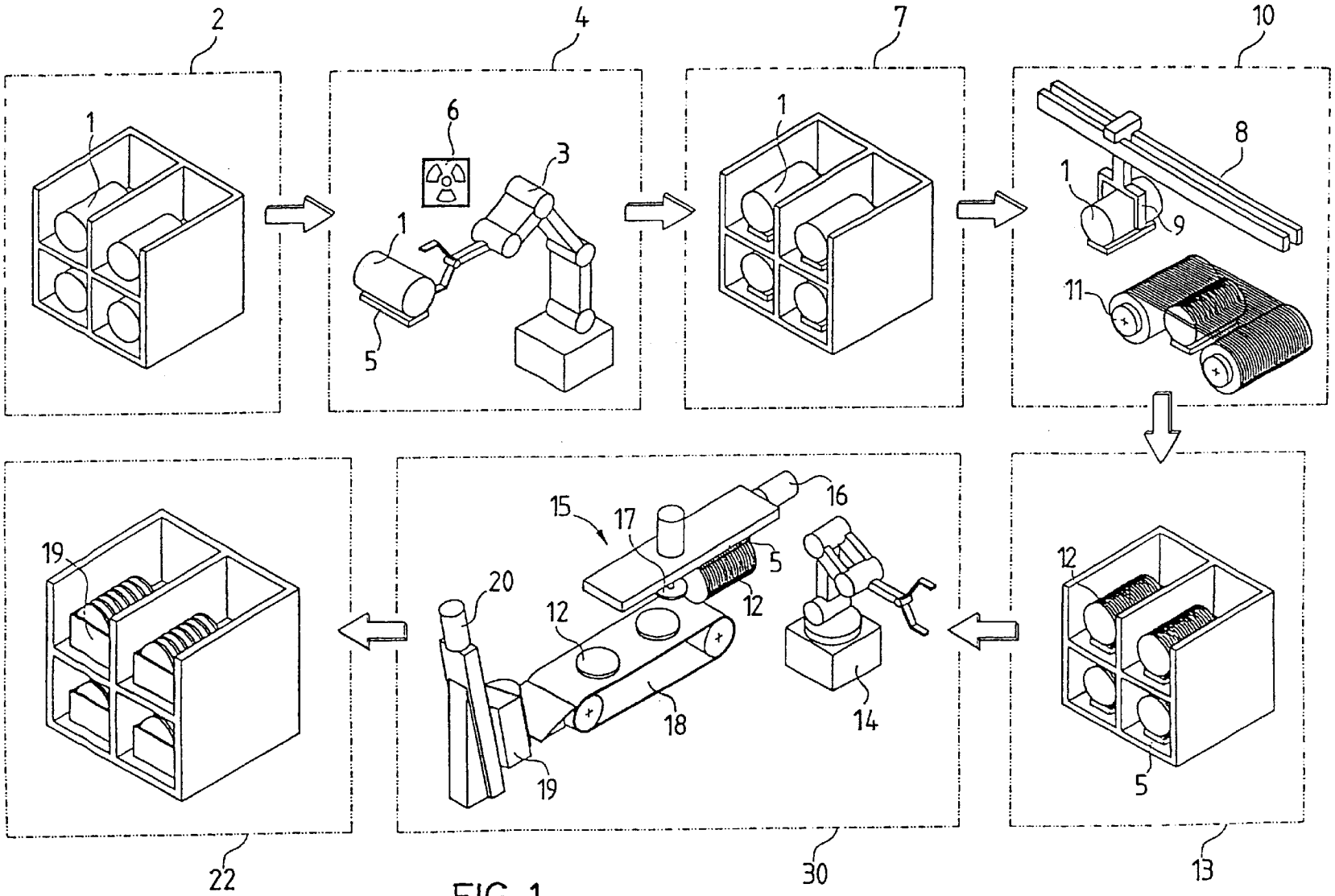
FIG. 1 is an organigram of a slicing center.

FIG. 1 shows a possible organigram for carrying out the present invention with different possible intermediate storages. The piece 1 to be sliced is stored in an input storage 2. The robot 3 of the positioning unit 4 positions it after having if desired measured it, on the R-X generator 6. Then the piece 1 to be sawed, positioned on the support 5, is placed at the ready in the first intermediate storage 7. The piece 1 to be sawed is then taken back by the manipulator 9 of the slicing unit 10 mounted on a rail 8 and introduced into the slicing device 11, in this case a wire saw. After sawing, the slices 11, still adhering to the support 5, are placed in waiting in the second intermediate storage 13 before being taken back by a new manipulator 14 to be introduced into the processing unit 30 comprising the processing device 15. The slices 12 mounted on their support 5 are presented one after the other by the motor 16, to a saw blade 17 which sections the heel which retains the slices 12. These latter therefore will fall onto the conveyor 18 and will be introduced, one after another, into the tray 19 which moves downward thanks to the motor 20. The trays once full will be transported by a conveyor belt into the output storage 22.

Figure 2:
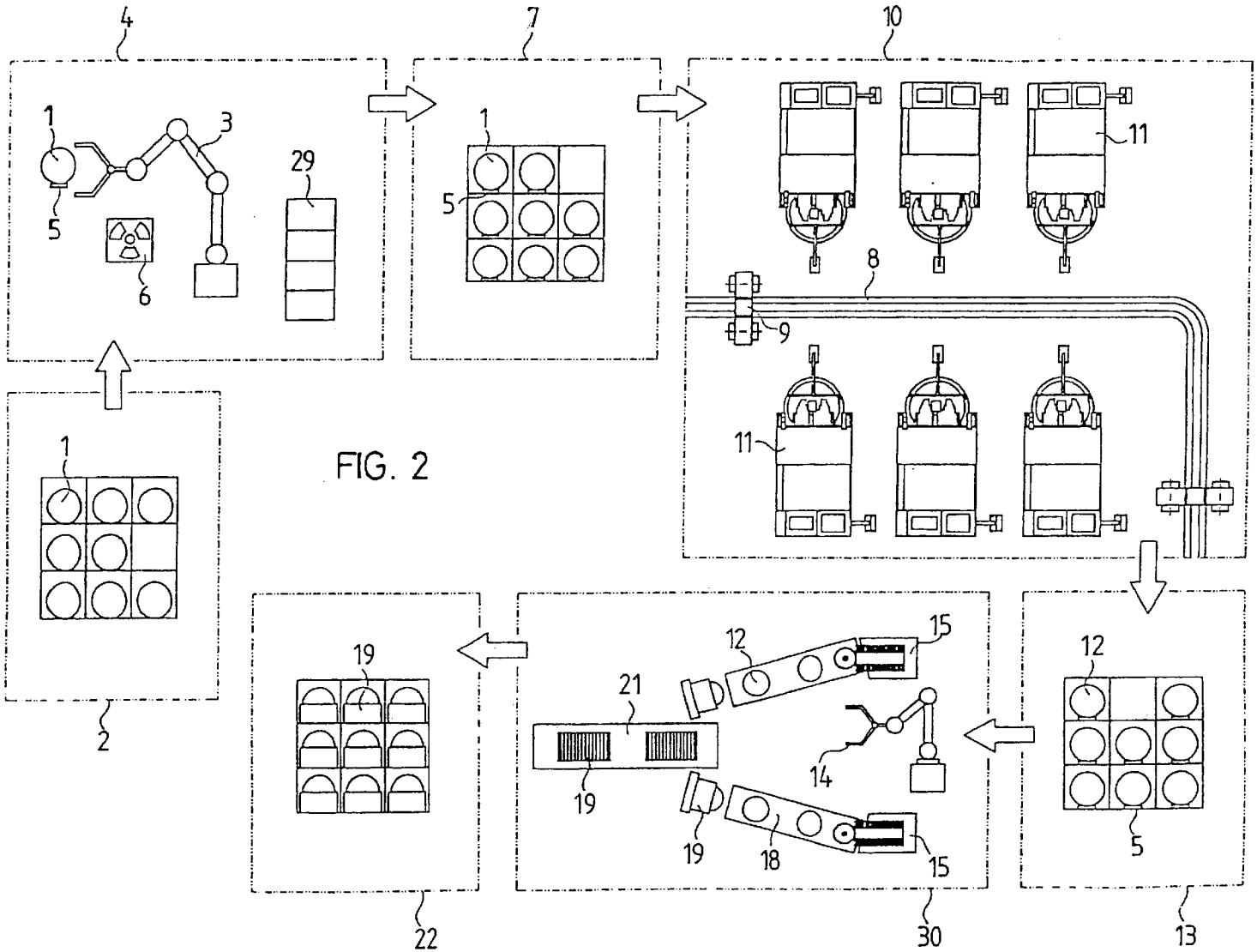
FIG. 2 shows a modification.

FIG. 2 gives a plan view of a possible modification of the slicing center. This pieces 1 to be sliced are stored in an input storage 2. The robot 3 of the positioning unit 4 positions, after having if desired measured on the general R-X 6, the piece to be sliced 1 on the support 5 in the mounting station 29. It is then placed in waiting in the first intermediate storage 7. The piece to be sliced is then taken by the manipulator 9 and the slicing unit 10 mounted on the rail 8 and introduced into one of the slicing devices 11 of which there are 6 in this example. After slicing, the slices 12, still adhering to the support 5, are placed at the ready in the second intermediate storage position 13 before being taken back by a new manipulator 14 to be introduced into one of the two processing devices 15 which constitute the processing unit 30. The slices 12, once separated from their support, are transported by the conveyor 18 and then placed into trays 19. The trays 19 are transported by conveyor belts 21 to this output storage 22.

Figure 3:
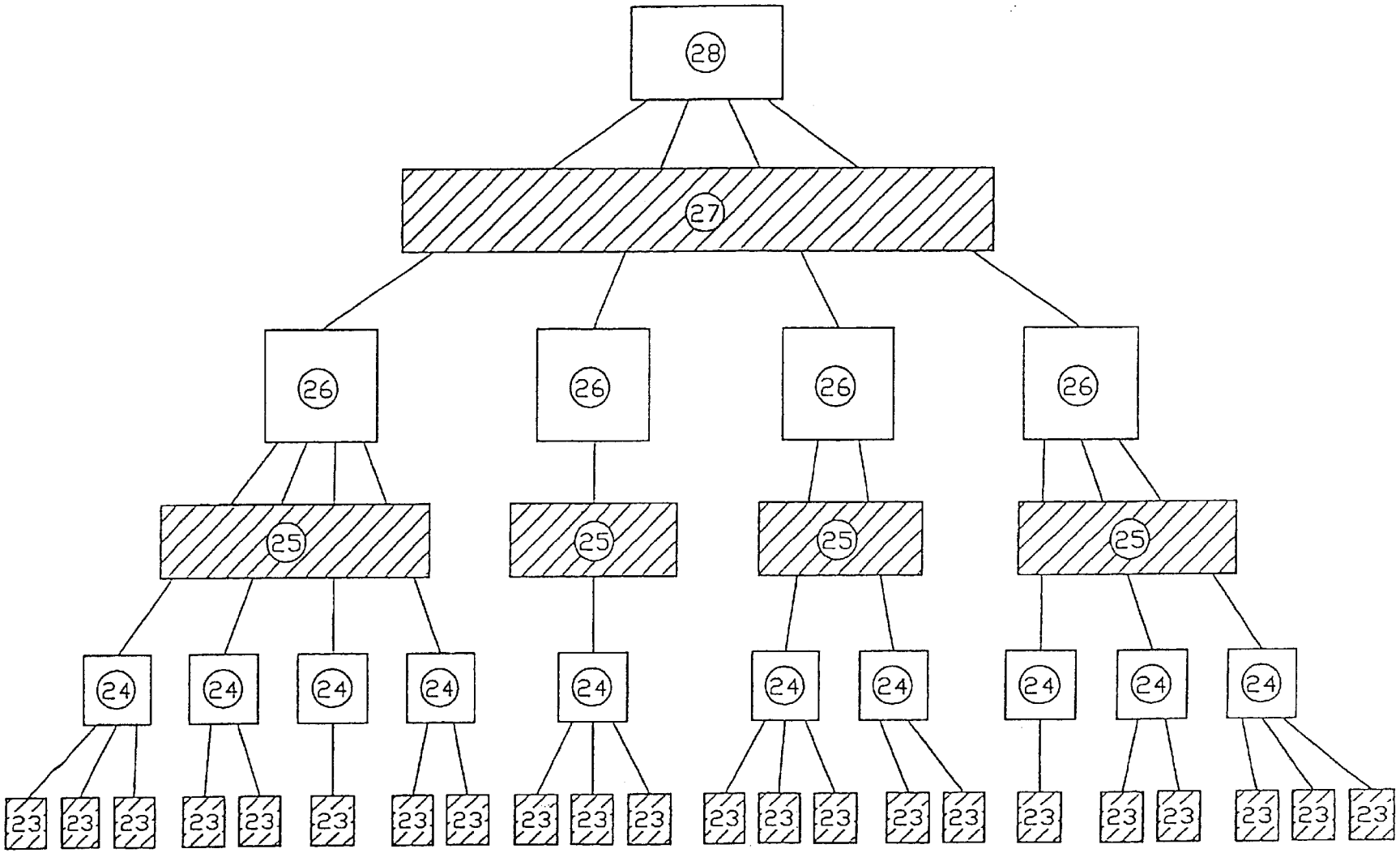
FIG. 3 shows the general principle of hierarchical organization of a slicing center.

FIG. 3 shows a possible schematic organigram of a slicing center. The first means 23 are grouped in operations 24. The second means 25 control a certain number of operations 24 and form subgroups 26. These latter are interconnected by third means 27 to form the slicing center 28.

Figure 4:
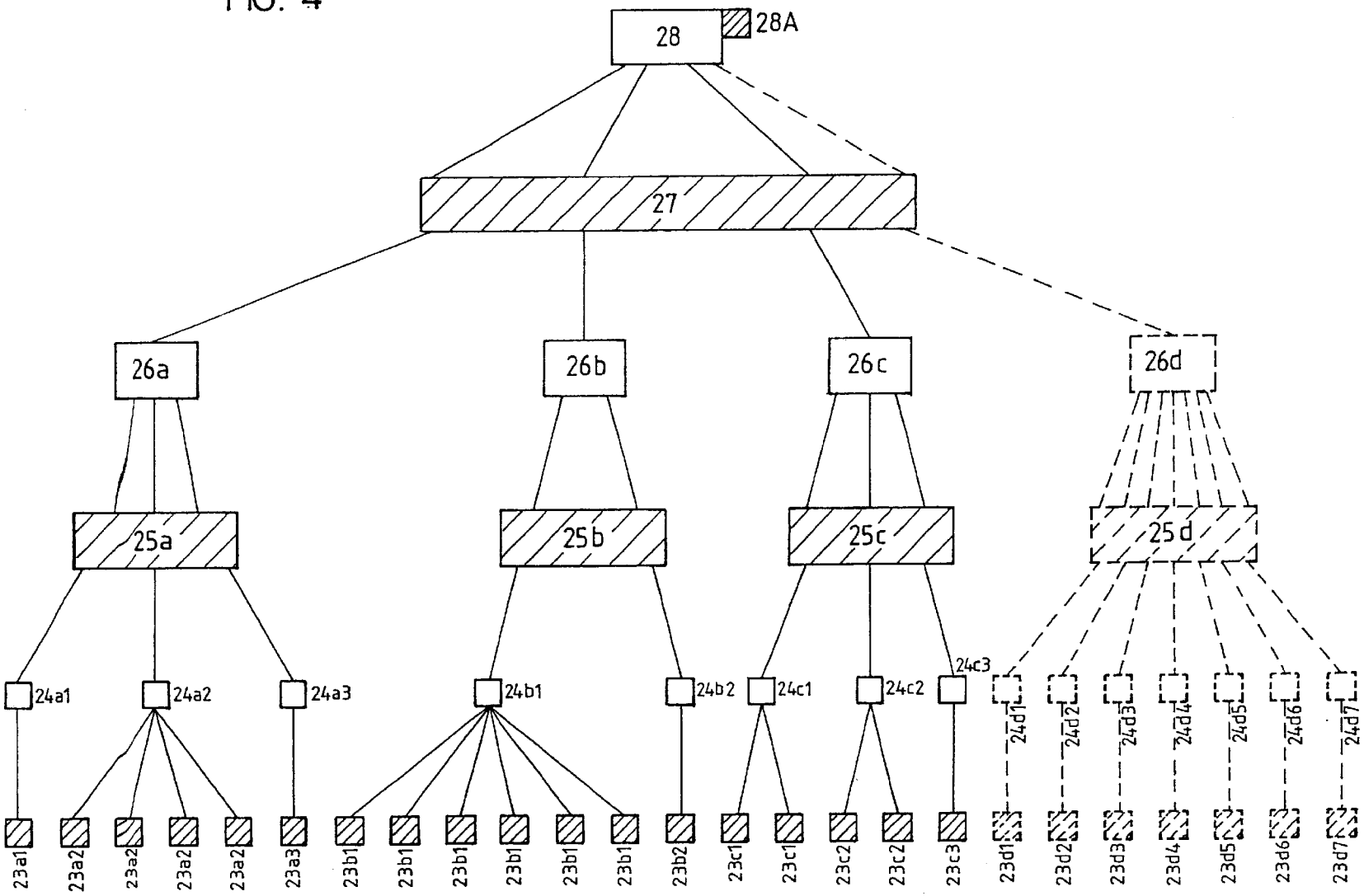
FIG. 4 shows by means of an organigram an example of embodiment of organization of another slicing center.

FIG. 4 shows a practical example of an organigram of an embodiment of the slicing center 28.

The first means 23*a*1 to 23*a*3 of the positioning unit 26*a* comprise:

an R-X generator 23*a*1 to carry out the operation 24*a*1 of determination of the crystallographic orientation, four mounting stations 23*a*2 to carry out the operation 24*a*2 of cementing the piece to be sliced on a single-use support in a predetermined orientation, a securement station 23*a*3 to obtain the securement operation 24*a*3 of the piece to be sliced with its single-use support on a support plate of the slicing machine.

These different operations are controlled and interconnected by second means 25*a*, constituted for example by a robot to form subgroup 26*a* corresponding to the positioning unit.

The slicing unit 26*b* comprises as first means, six slicing machines 23*b*1, which are for example wire saws carrying out the slicing operation 24*b*1, and a shower 23*b*2 to proceed to a precleaning operation 24*b*2.

The connection between the two operations is effected by second means 25*b* constituted by a manipulator on a rail to form a second subgroup 26*b*.

The sawed slices which continue to adhere by a heal to their single-use support are then treated in the processing unit forming the subgroup 26*c*.

This latter comprises as first means:

two ribbon or disc saws 23*c*1 carrying out the separation operation 24*c*1 of the slice from the single-use support, two tray elevators 23*c*2 to carry out the operation 24*c*2 of placing in a tray, and a cleaner 23*c*3 with a cleaning liquid jet to carry out a cleaning operation 24*c*3 of the separated slices.

The assembly of these operations can be controlled by means of conveyor belts forming second means 25*c* of the processing subgroup 26*c*.

The slicing unit 28 could if desired also be completed by a final treating unit forming a subgroup 26*d*.

The first means of these latter could comprise a milling device 23*d*1 adapted to the operation of removing the heel 22*d*1, a burr 23*d*2 carrying out the chamfering operation 24*d*2, a polisher 23*d*3 and a lapping member 23*d*4 for polishing 24*d*3 and lapping 24*d*4, a washing member 23*d*5 to carry out final washing 24*d*5, inspection and measurement apparatus 23*d*6 adapted to quality control 24*d*6 and a member 23*d*7 adapted for the marking 24*d*7 of the obtained slices. The assembly of these operations 24*d*1 to 24*d*7 could be connected by second means 25*d* constituted by manipulators and/or conveyors to obtain a continuous chain forming the ultimate treatment unit 26*d*.

The three or four units corresponding to subgroups 26*a* to 26*d* are interconnected by third means 27 to constitute a slicing center 28 forming a coherent assembly. These third means comprise input storage members, intermediate between certain ones or all of the subgroups and output, and transport and manipulation means comprising manipulating robots and/or conveyors. The different first, second and third means could be controlled and inspected altogether or partially by a central data control unit 28A.

The overall concept of slicing by the integration of the assembly of the functions from the piece to be sliced to the processed slice, permits carrying out an assembly which is simpler to use, more flexible and easier to control. Because of the fact that its control can be entirely or partially automated, the risks of error are minimized and render the assembly more reliable. There is thus obtained a maximum performance, productivity and flexibility, without detriment to the quality of the slices produced.

Naturally, other solutions to the overall concept of slicing can be envisaged which by their functions carry out the integration of the necessary functions and the obtention of a complete production unit for slices from a piece to be sliced until the processing in trays or even farther along. For example, the user of a single manipulator without intermediate storage can be envisaged. The different subgroups of operations can be more or less automated.

The second means 25*a* to 25*d* could also carry out certain of the functions of the third means 27 and vice versa. Thus, the robot of the positioning unit could also transport and direct the pieces to be sliced into the intermediate storage. The manipulator on a rail of the slicing unit could also carry out the transport of the first intermediate storage toward the slicing machines and of the precleaning shower toward the second intermediate storage before the processing unit 26*c*. Other first means 23 and other operations 24 could be provided and integrated into the slicing center. Certain operations could be integrated into the adjacent subgroups. Thus, the securement 24*a*3 of the piece to be sawed with its single support on the support place of the machine could be carried out in the framework of the subgroup 26*b* of the slicing unit. The precleaning 24*b*2 could be omitted or integrated into the following subgroup 26*c*. The members and operations for mechanical preparation, namely removing the heel, chamfering, polishing and lapping, and the operations of cleaning and final washing could also be integrated into the third processing subgroup 26*c*. The choice of the number of each member and device of the first, second and third means will be determined as a function of the desired production capacity.

Certain of the first, second and third means could also be carried out manually. Of course it is also possible that certain operations described with reference to FIGS. 1, 2 and 4 could be omitted.

However, the solutions must maintain the character of the overall concept of slicing by connecting the assembly of the operations, from the piece to be sliced to the processed slice, in a single operation.

What is claimed is:

1. A slicing center for producing slices from pieces to be sliced comprising in combination:

a positioning subgroup unit positioning the pieces to be sliced;

a slicing subgroup unit slicing the pieces to be sliced into slices after the pieces to be sliced have been positioned by said positioning subgroup unit;

a processing subgroup unit processing the slices from said slicing subgroup unit;

wherein each of said positioning, slicing, and processing subgroup units comprises, first means for carrying out the respective function thereof, and second means for interconnecting said first means in a physically operative manner so as to form the respective subgroup unit; and said slicing center further comprising interconnecting means for interconnecting said positioning, slicing, and processing subgroup units in a physically operatives hierarchically organized assembly, and comprising means for storing the slices, means for manipulating the slices, and means for transporting the slices.

2. The slicing center according to claim 1, wherein the functions of said third means are executed at least partially by said second means or are integrated therewith.

3. The slicing center according to claim 1, wherein said positioning unit comprises a multiaxial robot for performing all the operations between selection of the piece to be sliced and its securement in an oriented position on a support for mounting on said slicing unit.

4. The slicing center according to claim 1, wherein the slicing unit comprises at least one of a saw with free abrasive and a saw with at least one diamond encrusted blade.

5. The slicing center according to claim 1, wherein said processing unit comprises at least one processing device for placing slices in trays.

6. The slicing center according to claim 5, wherein said processing device comprises at least one separation member for separating the slices from a heel to which they are attached, a conveying member for bringing the slices to a member for placing them in said trays.

7. The slicing center according to claim 1, wherein the processing unit comprises a device for carrying out cleaning operations.

8. The slicing center according to claim 1, further comprising a fourth subgroup forming a final treatment unit that is connected to said processing unit.

9. The slicing center according to claim 8, further comprising a device for carrying out mechanical preparations of the slices in one of the processing unit and the final treatment unit.

10. The slicing center according to claim 9, wherein said device for carrying out mechanical preparations comprises members for carrying out at least one of the operations of removing the heel from the slice, chamfering, polishing and lapping the slices.

11. The slicing center according to claim 8, wherein said final processing unit comprises members for carrying out at least one of the operations of final cleaning, quality inspection and marking of the slices.

12. The slicing center according to claim 1, wherein said third means comprises at least one input storage device, at least one intermediate storage device, at least one final storage device, and transport and handling means comprising at least one manipulating robot or a conveyor.

13. The slicing center of claim 1, wherein, said positioning subgroup unit comprises the following said first means, an R-X generator determining a crystal orientation of the piece to be sliced, a mounting station attaching the piece to be sliced to a single-use support, and a securement station placing the single-use support on a support plate, said slicing subgroup unit comprises the following said first means, a slicing machine slicing the piece to be sliced and slicing a portion of said single-use support, thereby defining the slices that remain attached to said single-use support, and said processing subgroup unit comprises the following said first means, a saw detaching the slices from said single-use support, a conveyor placing the detached slices in a tray, and a cleaner cleaning the detached slices.

14. A slicing center for producing slices from a piece to be sliced comprising in combination:

plural apparatus means, each for performing a respective one of plural manufacturing steps in the slicing of a piece to be sliced;

ones of said plural apparatus means that perform similar ones of said manufacturing steps being operatively joined into separate manufacturing operations;

first interconnecting means for operatively interconnecting successive ones of said manufacturing operations into respective functional subgroup units, each of said functional subgroup units performing a related function;

said functional subgroup units including at least a positioning subgroup unit comprising ones of said apparatus means for performing positioning operations on the piece to be sliced, a slicing subgroup unit comprising ones of said apparatus means for slicing the piece to be sliced after the piece to be sliced has been positioned by said positioning subgroup unit, and a processing subgroup unit comprising ones of said apparatus means for processing the slices from said slicing subgroup unit; and the slicing center further comprising second interconnecting means for interconnecting said functional subgroup units in a physically operatives hierarchically organized assembly, and comprising slice storage, slice manipulation and slice transport members.

15. The slicing center of claim 14, wherein, said positioning subgroup unit comprises an R-X generator determining a crystal orientation of the piece to be sliced, a mounting station attaching the piece to be sliced to a single-use support, and a securement station placing the single-use support on a support plate, said slicing subgroup unit comprises a slicing machine slicing the piece to be sliced and slicing a portion of said single-use support, thereby defining the slices that remain attached to said single-use support, and said processing subgroup unit comprises a saw detaching the slices from said single-use support, a conveyor placing the detached slices in a tray, and a cleaner cleaning the detached slices.

* * * * *